United States Patent [19]

Tonner

[11] Patent Number: 4,767,121

[45] Date of Patent: Aug. 30, 1988

[54] APPARATUS FOR SIMULATING PLAY ON A GOLF COURSE OR DRIVING RANGE

[75] Inventor: Peter S. Tonner, Saskatoon, Canada

[73] Assignee: Joytec Ltd., Saskatoon, Canada

[21] Appl. No.: 804,168

[22] Filed: Dec. 3, 1985

[30] Foreign Application Priority Data

Dec. 5, 1984 [GB] United Kingdom ..... 8430650

[51] Int. Cl.[4] ..... A63B 69/36

[52] U.S. Cl. ..... 273/185 A; 273/185 B

[58] Field of Search ..... 273/185 A, 35 B, 185 D, 273/186 B, 186 C, 183 A, 197 A, 200 R, 200 B, 32 H, 181 H, 186 A, 186 R; 434/252

[56] References Cited

U.S. PATENT DOCUMENTS

| | | | |
|---|---|---|---|
| 2,715,338 | 8/1955 | Simjian | 273/185 A |
| 2,897,674 | 8/1959 | McNeill | 273/200 B X |
| 3,535,936 | 10/1970 | Howell | 273/185 D |
| 3,601,408 | 8/1971 | Wright | 273/185 D X |
| 3,659,284 | 4/1972 | Rusch | 273/185 A X |
| 3,712,624 | 1/1973 | Conklin . | |
| 3,738,660 | 6/1973 | Branz et al. . | |
| 3,743,296 | 7/1973 | Branz . | |
| 3,769,894 | 11/1973 | Conklin . | |
| 3,778,064 | 12/1973 | Nutter . | |
| 4,023,809 | 4/1978 | Speiser et al. . | |
| 4,063,259 | 12/1977 | Lynch et al. | 273/186 R |
| 4,086,630 | 4/1978 | Speiser et al. . | |
| 4,150,825 | 4/1979 | Wilson | 273/181 H |
| 4,160,942 | 7/1979 | Lynch et al. | 273/185 A |
| 4,304,406 | 12/1981 | Cromarty . | |
| 4,343,469 | 8/1982 | Kunita et al. . | |
| 4,429,880 | 2/1984 | Chen et al. . | |
| 4,615,526 | 10/1986 | Yasuda et al. . | |
| 4,655,451 | 4/1987 | Townsley | 273/32 H |

FOREIGN PATENT DOCUMENTS

| | | |
|---|---|---|
| 183774 | 3/1984 | Japan . |
| 232566 | 7/1984 | Japan . |
| 232565 | 11/1984 | Japan . |
| 73676 | 4/1986 | Japan . |

*Primary Examiner*—MaryAnn Lastova

*Attorney, Agent, or Firm*—Leonard Bloom

[57] ABSTRACT

A golf simulating apparatus is capable of simulating play on a golf course and/or a driving range. A pivotally mounted resilient ball member (38) is arranged to be impacted with the head of a golf club as the club is swung by the player. Special sensors are associated with the ball member (38) to sense its velocity and any lateral deviation from a fixed plane of movement (Y-Y) thereby to provide signals representing a probable distance and direction of ball travel. These signals are applied to the input ports of a computer (80) which is programmed to provide output signals to a monitor (20) so that it displays a simulated golf course or driving range, with the simulated path of ball travel and/or landing position being displayed on the golf course or driving range. The program provides the golf course or driving range with selected hazards (water, sand, trees etc.). Provision is made for counting and displaying the number of strokes, for averaging distances, assessing penalties and the like thereby to provide a simulation of conditions likely to be encountered during actual play of a game of golf.

19 Claims, 15 Drawing Sheets

TO FIG. 16B

APPARATUS FOR SIMULATING PLAY ON A GOLF COURSE OR DRIVING RANGE

BACKGROUND OF THE INVENTION

This invention relates to golf simulating apparatus and in particular to a system capable of simulating a golf driving range and/or a golf game. The golf simulator is designed to provide both the golfer and the non-golfer with many of the features that he or she would normally enjoy during a visit to an outdoor driving range or golf course.

The prior art has provided numerous devices designed to simulate a golf game. The earlier devices were primarily of a mechanical nature and included a simulated golf ball mounted for impact by a golf club coupled with structure for generating information as to how far a real golf ball would travel in response to the same impact. Later devices incorporated additional sensing means for generating information relating to the direction of travel of the simulated ball, e.g. hook and slice information. More recently, sophisticated mountings for the simulated ball were devised enabling the ball to move about three mutually perpendicular axes in an effort to simulate more closely the movement of an actual golf ball after impact. Other quite sophisticated simulators have been devised including systems capable of storing data representing the contours of a simulated golf green coupled with means for detecting the velocity vector of a rolling ball and computing means for computing an imaginary trajectory of the ball rolling on the simulated green based on the detected velocity vector and the stored green surface contour data.

In spite of the very considerable time and effort which has been expended by others in developing a suitable golf simulating system, most of the golf simulators and practicing devices presently available possess certain disadvantages which have reduced considerably their acceptance by the public.

One common problem with prior art golf simulators relates to the rapid deterioration of the sensing mechanism. It has to be kept in mind that at the moment of impact, the golf club may be moving at a velocity of close to 380 kilometers per hour. The impact of the club head with the sensing mechanism has created serious problems in many cases as a result of the repeated heavy shocks and resulting vibrations. This is a particularly serious problem when the golf simulator is operated on a commercial basis since equipment failure gives rise to lengthy down-time and loss of potential revenue coupled with often expensive servicing and maintenance procedures.

Most of the prior art golf simulators also failed to provide the player with sufficient visual information as to genuinely simulate a golf game. Although many prior art simulators do provide information in various formats to the player, the type of information provided usually did not leave the player with a feeling of satisfaction and enjoyment and accordingly the players soon became tired of the game with the result being that the equipment gradually fell into a condition of non-use.

SUMMARY OF THE INVENTION

It is a general object of the present invention to provide an improved golf simulator which can take either the form of simulated golf driving range or a simulated golf game, which simulator has been designed to provide the player with many of the features which would be normally enjoyed during the course of an actual visit to an outdoor driving range or golf course. This system has been designed to allow the player or players to make a number of choices regarding playing conditions thereby to provide enjoyment regardless of the level of golfing skill possessed. The system is rugged and durable, possessing few moving parts and hence is suitable for both indoor and outdoor use. Because of its simplicity and durability, the golf simulator is well-suited for commercial operation with, for example, playing of a game being commenced in response to the deposit of coins in a coin box provided on the machine.

In accordance with one aspect of the invention there is provided a golf simulator including a movable ball means comprising a stem having a simulated golf ball connected thereto. This movable ball means is supported for rotation about an axis from a first position to a second position in response to impact between the simulated golf ball and the head of a golf club being swung by a user. A plane of movement is defined by an imaginary plane which is normal to said axis and in which the simulated ball is located when in the first position. The simulator includes sensor means capable of, among other things, sensing the arrival of the movable ball means at the second position. The movable ball means and/or said supporting means are/is sufficiently resiliently deformable or deflectable that the simulated golf ball can be momentarily deviated to one side or the other of the plane of movement in response to at least the angle of impact of the club head with respect to the simulated ball relative to the plane of movement. The above-noted sensor means is also capable of sensing any momentary deviation of a simulated golf ball from the plane of movement at the point of arrival of the movable ball means at the second position thus enabling the direction of travel of the ball to be computed in response to an output from the sensor means.

In a preferred form of the invention the above-noted movable ball means and/or the supporting means are/is of a resiliently deformable rubber or rubber-like material. Such materials not only assist in enabling ball direction to be sensed by virtue of the resilient deformation which takes place upon impact but, in addition, serve to absorb shock and vibration thus providing for relatively long, trouble-free operation.

Typically, the sensor means may comprise an array of sensors located so as to be responsive to pressures acting thereon and developed by the arrival of the simulated golf ball at the second position.

Preferably, the second position is defined by a sensor pad arranged so as to be impacted by the golf ball when the movable ball means reaches its second position. The sensor pad may include a layer of resiliently deformable material for absorbing the shock of impact of the simulated ball at the second position. The array of sensors is desirably located beneath this layer of material and is disposed on opposing sides of the plane of movement such that the sensors are responsive to pressure waves transmitted through the resilient material from the point of ball impact on the surface of the sensor pad.

The sensor pad is typically shaped so that the simulated ball initially impacts with the pad surface in such a way as to clearly define the point of impact. This enables ball direction to be accurately established.

The preferred material for both the movable ball means and sensor pad is resilient polyurethane elastomer material. Preferably, the movable ball means has a hardness which is greater than the hardness of the sensor pad.

In a preferred form of the invention the supporting means is formed integrally with the sensor pad. The supporting means may include trunnion members supporting an axle which defines the axis of rotation of the movable ball means from the first to the second position. The resiliency of the trunnion members, in the preferred form of the invention, assists in taking up shock and vibration forces as noted above, while the resilient material of the sensor pad takes up shock and vibration and protects the array of sensors from damage.

Preferably, the movable ball means and the supporting means are arranged so that the stem of the movable ball means slopes in a direction upwardly and away from the second position and toward the direction of swing of the golf club. The slope is such that the club head contacts the simulated ball but not the stem during the course of a normal stroke.

The above-noted sensor means, in a typical embodiment of the invention, includes a first sensor and a second sensor. The first sensor senses movement cf the movable ball means away from the first position while the second sensor senses the arrival of the movable ball means at the second position together with any deviation of the simulated ball from the plane of movement. The combined outputs of the first and second sensors enable ball distance and direction of travel to be computed by a suitably programmed computer.

As a further major aspect of the invention there is provided a golf game simulator including a simulated golf ball adapted to be impacted by the head of a club being swung by a user. Sensors are associated with this simulated golf ball and they are arranged to emit signals representing the magnitude and direction of the velocity of the simulated ball at the region of impact. A computer system is provided for receiving signals from the sensor means and computing a probable ball direction, distance of travel and landing position and emitting signals corresponding thereto. The system also includes means for generating display signals representing a simulated fairway or driving range. Suitable means, including a monitor, are provided for processing the display signals and producing visual images representing the same such that the images of the ball's path of travel and/or landing position are/is superimposed on the images of the simulated fairway or driving range.

As a further desirable feature, the computing system may include means generating, as a part of the simulated fairway display, signals representing a tee-off point, a green and hole, and at least one hazard. The hazards are strategically located and may consist of one or more of the usual hazards such as sand traps, water, and trees.

As a further feature, the computing system is programmed such that in the event the calculated landing position of the ball coincides with a hazard, a new ball position is established after a pre-determined time delay and the ball is moved to the new position. Interaction is made with a counting means to increase the accumulated total count by a prescribed number of penalty strokes.

The system also typically includes means for counting the number of times the simulated ball is struck and generating display signals representing the accumulated total stroke count.

The computing system may also include one or more of the following features:

(a) means storing the distances the ball is moved, averaging the distance and including the average distance per stroke as part of said display;

(b) means for registering placement of the ball in the hole when the calculated landing position of the ball is within a selected distance of the pre-calculated hole position;

(c) means for disabling a portion of said computing system and to signal the end of a game of simulated golf after (a) elapse of a set period of time and/or (b) accumulation of a prescribed stroke count;

(d) input means enabling the player to select one of several clubs, which selection alters the manner in which said computer responds to ball distance inputs from said sensor means to produce distance outputs conditioned in accordance with the club selected;

(e) input means enabling the player to select one of several fairway or driving range distances according to the ability of the player.

The computing system is also desirably arranged such that when the calculated ball landing position coincides with the hole position, the ball is returned to the tee-off position a prescribed period of time after landing in the hole.

Further features of the invention will become apparent from the following description of a preferred embodiment of same and from the claims appended hereto.

BRIEF DESCRIPTION OF THE VIEWS OF DRAWINGS

DETAILED DESCRIPTION OF THE PREFERRED EMBODIMENT

Figure 1:
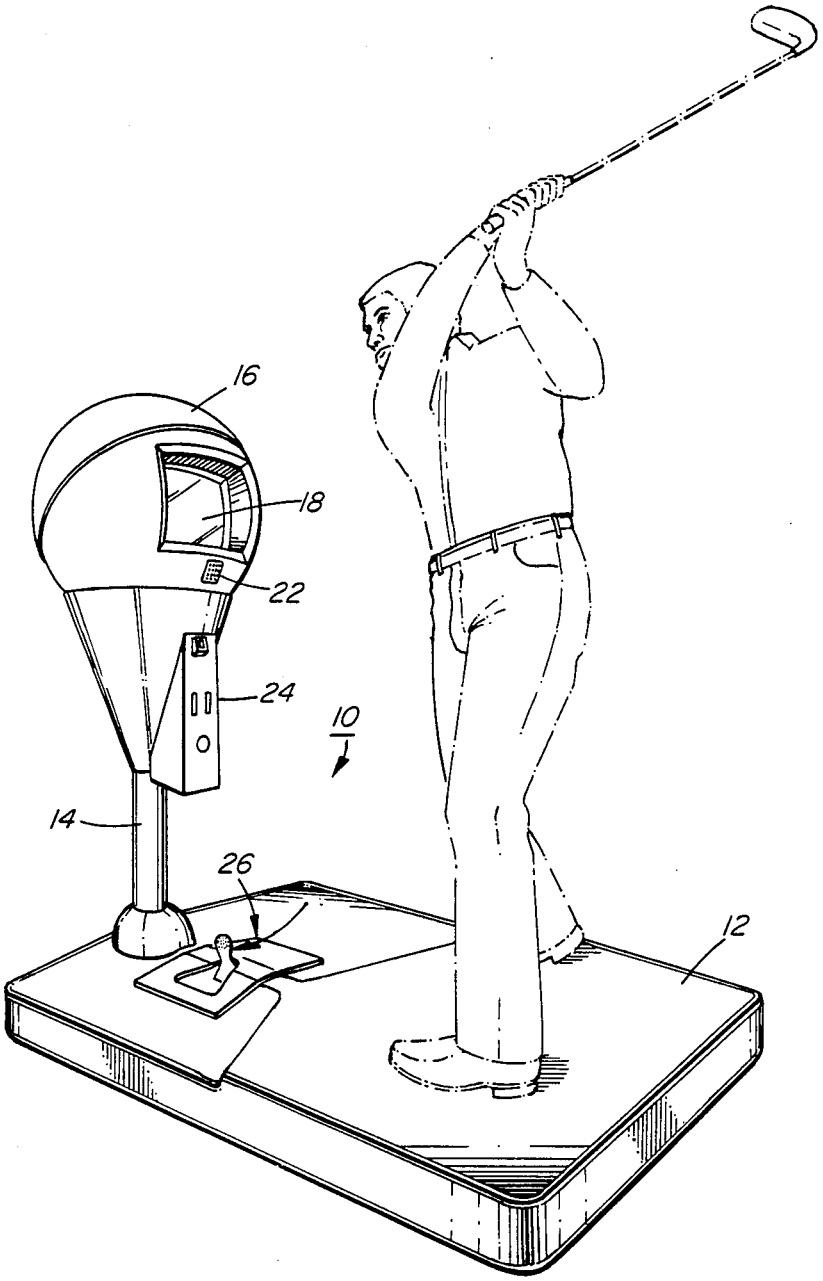
FIG. 1 is a perspective view of a golf simulator in accordance with a preferred embodiment of the invention.
Figure 9:
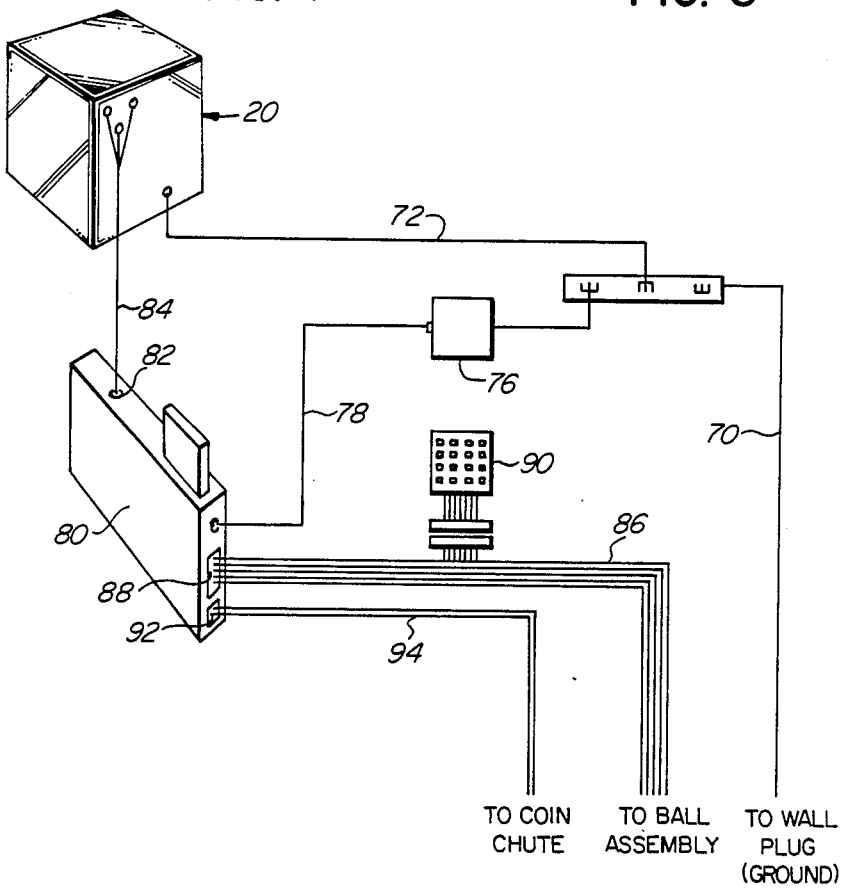
FIG. 9 is a diagramatic view of the several components and their wiring located in or on the monitor housing.
Figure 10:
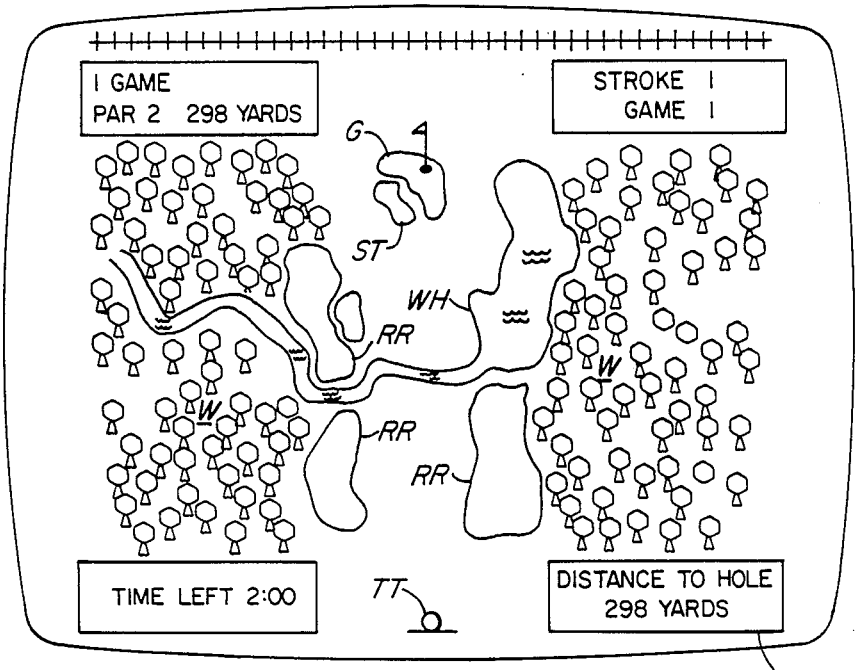
FIG. 10 illustrates a typical monitor display of a simulated one hole golf course.
Figure 11:
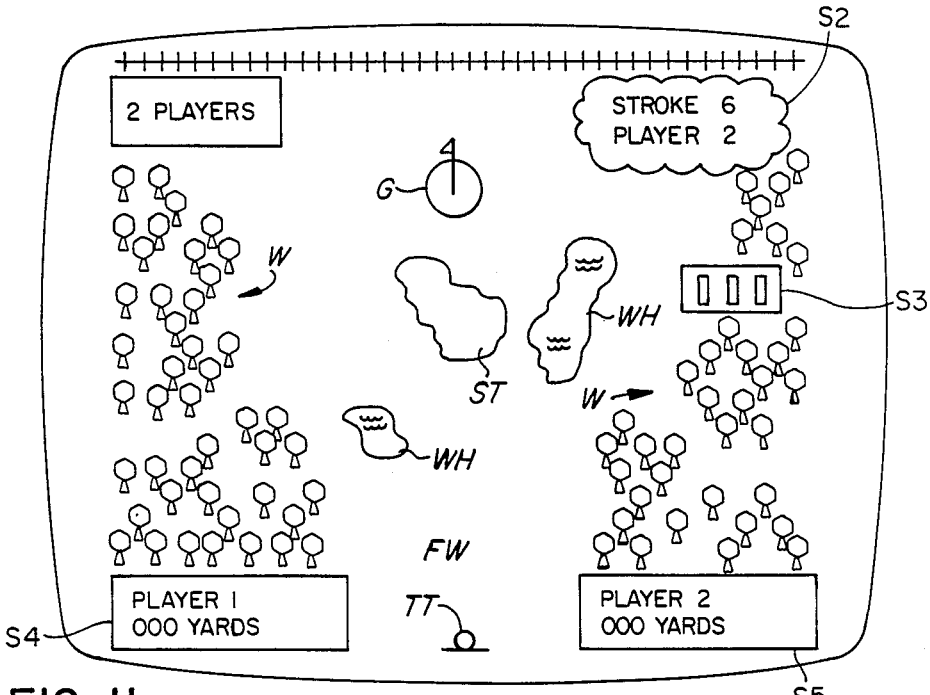
FIG. 11 is a typical monitor display of a simulated driving range.

Referring now to the drawings, FIG. 1 is a perspective view of a golf simulator in accordance with the preferred form of the invention. The golf simulator 10 includes a generally horizontally disposed base 12 having a monitor stand 14 adjacent one end thereof which supports a monitor housing 16. The monitor housing and stand are designed as to provide a pleasing visual effect and, in this case, the visual effect is that of a golf ball mounted on a tee. The monitor housing 16 has a rectangular window opening 18 therein through which is displayed the screen of a monitor 20 (FIGS. 9, 10 and 11). The monitor housing 16 includes, in a convenient location below window 18, several control buttons 22 which are used in the manner described hereafter. The monitor stand 14 also serves to mount a coin chute and box 24. The coin chute and box may be omitted in models designed for use in a non-commercial fashion, e.g. for home use or for use in private clubs and the like. A switch or key may also be added to activate the unit.

Figure 2:
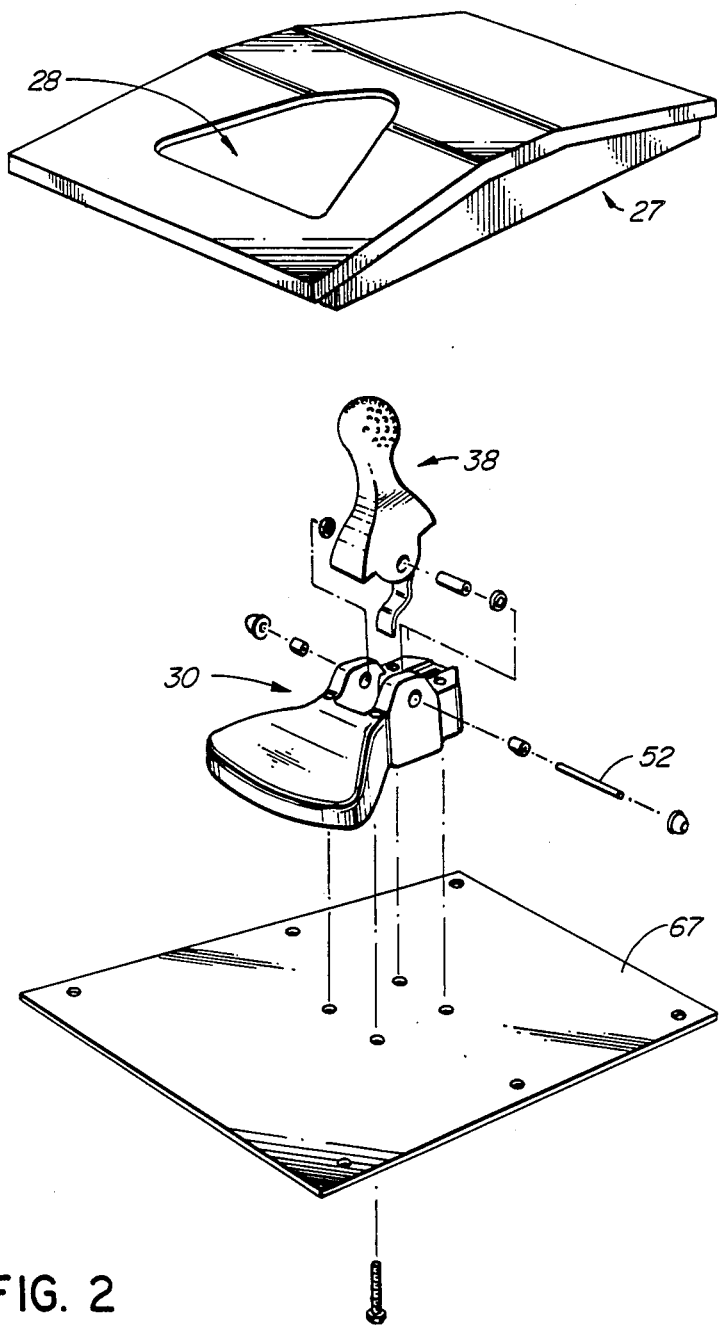
FIG. 2 is an exploded view of the ball assembly including the movable ball means and the support means therefor including the sensor pad and the ball housing.

A ball assembly 26 is located in a shallow rectangular recess in base 12 closely adjacent the lower end of the monitor stand 14. With reference to FIG. 2 it will be seen that the ball assembly 26 includes a ball housing 27 of generally rectangular outline and of a size as to enable it to be easily lifted out of or lowered into the rectangular recess provided in the upper surface of base 12 so that its direction can be reversed to accommodate a left handed or a right handed player. The ball housing 27 includes a recess 28 in the upper surface thereof, which recess has an outline shape in plan view designed so that the recess can receive a ball support 30 (see also FIGS. 3–5). It will be seen that the recess 28 in ball housing 27 is shaped so that it is fairly narrow adjacent the intermediate portion of the ball housing, with the recess walls thereafter diverging outwardly and away from one another such that the opposite end of the recess is relatively wide.

Figure 3:
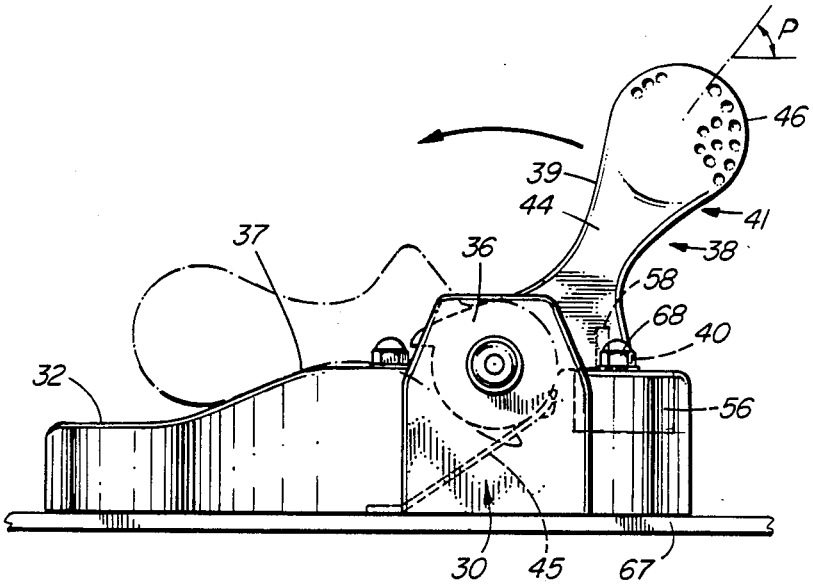
FIG. 3 is a side elevation view of the ball assembly.
Figure 4:
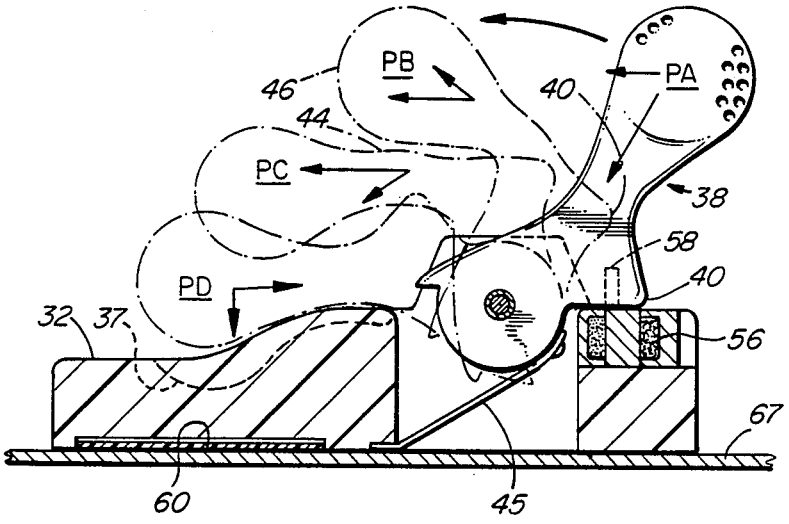
FIG. 4 is a further side elevation view of the ball assembly showing the movement of the ball means after the simulated golf ball has been struck by a golf club.
Figure 5:
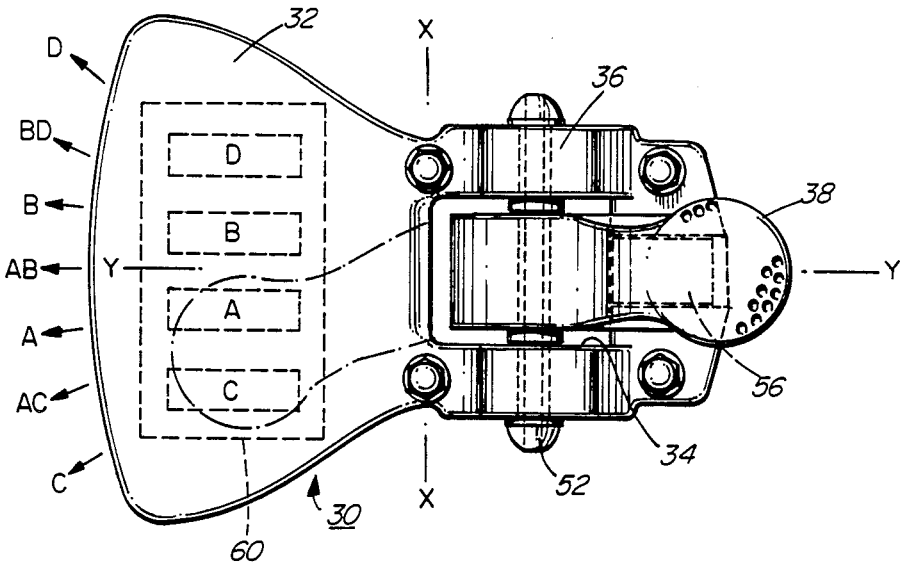
FIG. 5 is a plan view of the ball supporting means, with the array of sensors being shown in phantom and the various ball directions being illustrated by arrows.
Figure 7:
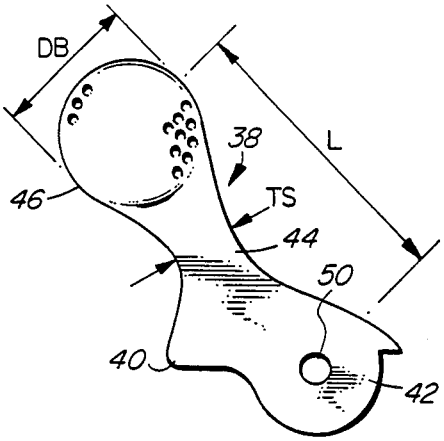
FIGS. 7 and 8 are side elevation and frontal views respectively of the movable ball means including the simulated golf ball.
Figure 8:
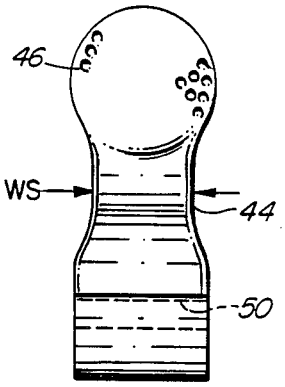

With reference to FIGS. 3, 4 and 5 it will be seen that the ball support 30 comprises a unitary body which is formed from a suitable rubber or rubber-like material such as polyester base polyurethane. The wide and somewhat shallower frontal portion of ball support 30 comprises a sensor pad 32. The rearward portion of the ball support has a centrally disposed recess 34 and defines a pair of spaced apart trunnions 36 between which is disposed the movable ball member 38 which is best seen in FIGS. 7 and 8. Ball member 38 includes a heel portion 40 and a foot portion 42. Extending upwardly and inclined rearwardly from the heel 40 is a stem 44 with a simulated golf ball 46 being located at the outer end thereof and integrally formed therewith. The stem 44 is shown as having a rectangular cross section (see the revolved section in FIG. 8).

Ball member 38 is preferably made from a unitary body of polyester base polyurethane having a hardness of about 70 on the Shore A scale. Some typical dimensions for the ball member 38 are given below as follows, with reference to FIGS. 7 and 8 of the drawings:

| | | |
|---|---|---|
| L | distance from center of ball to rotation axis | 10.5 cm. |
| DB | ball diameter | 4.2 cm. |
| TS | stem minimum thickness | 1.6 cm. |
| WS | stem minimum width | 3.0 cm. |

The foot portion 42 of the ball member has a transverse aperture 50 therein which receives a suitable bushing of low-friction material. In order to mount the ball member 38 to the ball support 30, the trunnions 36 have aligned apertures therein which serve to support a stainless steel axle 52, such axle also passing through the bushing disposed in the above-noted aperture 50 provided in the ball member 38. Suitable nuts mounted on opposing ends of axle 52 prevent the axle from moving end-wise.

It will be seen from the above description that the ball member 38 is thus mounted for rotation about the axis defined by axle 52 from a first position as illustrated in FIGS. 3 and 4, wherein the stem 44 projects upwardly and rearwardly, to a second position, as illustrated in phantom in FIGS. 3 and 4, wherein the ball member 38 has been rotated around such that the stem 44 and simulated golf ball 46 make contact with the upper surface of the sensor pad 32. When ball member 38 is in the first position, the simulated golf ball 46 lies in an imaginary fixed plane of movement Y—Y which is normal to the rotation axis (FIG. 5).

Returning now to the description of the ball support 30, it was noted above that this structure is preferably made in one piece from a polyester base polyurethane. In actual fact it has been found advantageous to make the ball support of two slightly differing polyurethane compositions. The approximate plane of demarcation between these two compositions is given by the line X—X in FIG. 5. To one side of this plane X—X lies the sensor pad 32 and this is advantageously made of polyurethane having a hardness of about 25–30 Shore A. To the other side of this line X—X the material is somewhat harder, preferably being in the order of about 70 Shore A, which is about the same hardness as that used for the ball member 38.

By virtue of the resilient deformability of the ball member 38 and the support structure therefor e.g. trunnions 36, the simulated golf ball 46 can be momentarily deviated to one side or the other of the plane of movement Y—Y in response to the angle of and velocity of impact of the club head with the golf ball relative to such plane of movement. If the ball is hit perfectly by the head of the golf club, the simulated ball 46 will remain in the plane of movement Y—Y as it travels from the first position to the second position. However, a less than perfect stroke corresponding, for example, to a hook or a slice condition or a so-called push or a pull (which terms are well known to golfers), will cause the simulated golf ball 46 to be deflected to one side or the other of this imaginary plane of movement. In order to employ this momentary deviation for purposes of establishing a direction signal, as well as a signal representing the velocity of ball travel, various sensors are associated with the ball support 30 and they will now be described.

Firstly, it will be noted that a small coil 56 is positioned adjacent the rear of the ball support 30. Coil 56 is provided with a suitable metal core. Coil 56 is positioned such that it directly underlies the heel 40 of the ball member 38 when the latter is in the first position as described above. Firmly embedded in the base of the heel 40 is a small permanent magnet 58. Hence, when ball member 38 is in the first position, the coil 56 lies in a magnetic field established by the presence of magnet 58. Once the simulated golf ball 46 is struck by a club, the magnet 58 is caused to move rapidly away from the core of the coil 56 which causes the magnetic field surrounding such coil to collapse rapidly thus producing an electrical signal which can be utilized in the manner described hereafter.

Turning now to the frontal end of the ball support 30 it will be seen that a generally flat ribbon switch 60 underlies and forms a part of the sensor pad 32. Ribbon switch 60 is designed to complete or close one or more of several circuits as a result of the simulated golf ball 46 impacting the upper surface of sensor pad 32 on arrival at the second position as described previously. With reference to FIG. 5 it will be seen that the ribbon switch 60 provides four main contact areas labelled D, B, A, C. If the simulated golf ball 46 is hit perfectly, the simulated ball will move in the plane of movement referred to above and strike the sensor pad at a point above and midway between contact areas A and B. With the contacts A and B both closed, a direction signal is established corresponding to the direction of the arrow AB in FIG. 5. If switch contact areas A and C are closed, a direction signal corresponding to arrow AC is produced. If impact occurs over contact area D, a signal corresponding to direction arrow D will be emitted. If, as a result of some unusual circumstance, contact should be made at any three contact areas simultaneously, for example, BAC, provision can be made in the computer program to indicate an intermediate direction.

The switch arrangement shown above is also capable of establishing the velocity of the simulated golf ball. As soon as the simulated golf ball leaves the first position and the magnetic field around coil 56 begins to collapse, the computer is arranged to commence a count, which count is interrupted as soon as the simulated ball 46 strikes the sensor pad above or more of the contact areas C, A, B, D. Hence, the sensor arrangement described above is capable of providing signals representing both the velocity and direction of travel of the simulated ball.

Figure 6:
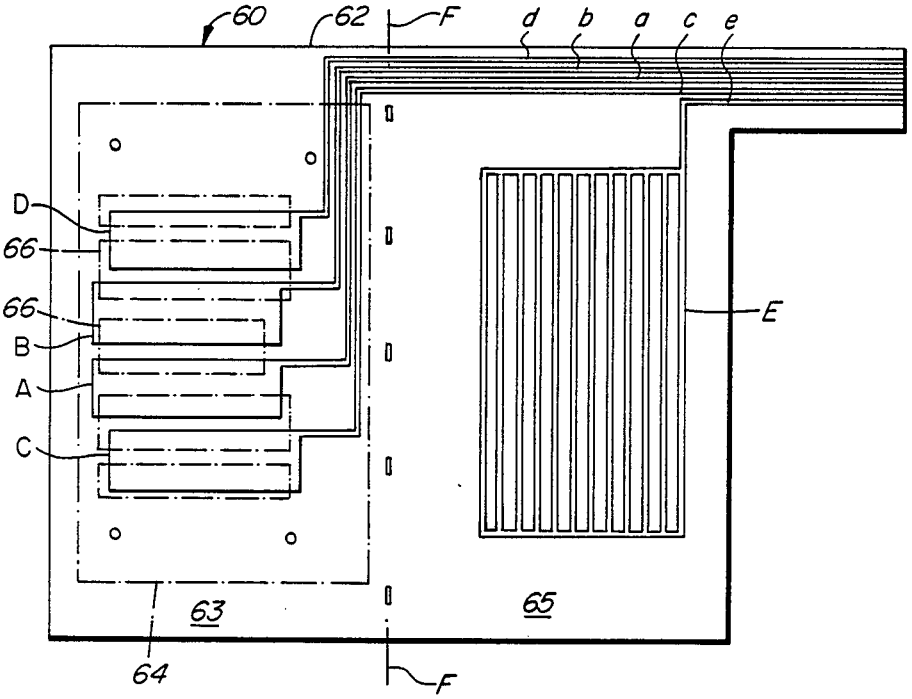
FIG. 6 is a plan view of the ribbon switch forming a part of the sensor pad.

The ribbon switch 60 is more clearly illustrated in FIG. 6. The switch comprises a thin flexible substrate 62 which is preferable of "Mylar" (registered trade mark) plastic material. A conductive metallic coating is selectively applied to the top surface of the flexible substrate by means of a silk-screening process thereby to form the contact areas D, B, A and C described previously and clearly shown in FIG. 6 together with their associated conductors d, b, a and c. The substrate 62 actually comprises two main areas 63 and 65. Between these two areas there is an imaginary fold line indicated by the dashed line F—F. When the substrate 62 is folded about line F—F the above described rectangular contact areas D, B, A and C are superimposed on a further relatively large contact area E comprising a series of spaced parallel conductive regions all connected in parallel to a common conductor e. Hence, contact between conductive area E and one or more of the contact areas D, B, A and C, will complete a circuit and provide the signals referred to above.

In order to prevent unwanted contact between contact area E and the four contact areas referred to above, a thin insulating separator strip 64 is provided, the same being illustrated in FIG. 5 by the dashed line and shown as being located over and above the four main contact areas D, B, A and C. It will be seen that this separator strip is provided with five rectangular windows 66. The three intermediate windows are of approximately the same size as the rectangular contact areas D, B, A and C and are staggered with respect thereto such that the first window 66 overlaps and exposes approximately one-half of each of contact areas D and B. The second window overlies and exposes portions of both contact areas B and A while the third window overlaps and exposes portions of both contact areas A and C. The outer-most windows are narrower than the three intermediate windows and they overlie portions of only contact areas D and C respectively.

As previously noted, the above described ribbon switch 60 is located on the lower surface of and forms a part of the sensor pad 32. As the simulated golf ball 46 strikes the upper surface of sensor pad 32, a pressure wave is transmitted through the elastomeric material and momentarily closes the contacts as described above. Because of the ability of the resilient material to absorb shock and vibration the ribbon switch 60, which in itself is rugged and durable, is well shielded from damage.

In order to provide a secure mounting for the ball support 30, a steel base plate 67 is secured to the bottom of the ball support 30 with the ribbon switch being sandwiched between the elastomeric material of the sensor pad 32 and the upper surface of the steel plate 67. Vertically disposed bolts 68 located adjacent the trunnions 36 securely mount the base plate 67 to the remaining components described above.

The various conductors printed on the ribbon switch 60 are each connected to suitable terminal points and the latter are connected to a wiring harness which leads to a terminal block. The leads from the coil 56 can also be combined with the leads from the ribbon switch whereby the electrical connection for the complete ball assembly may be made at a single terminal block or connector.

For a better understanding of the movement of ball member 38 from the first position to the second position noted above, reference should now be had to FIG. 4 which shows the configurations assumed by the ball member 38 as it moves from the first position PA to the second position PD.

With reference to position PA, it will be noted that the movable ball member 38 and the ball support 30 are arranged such that the stem 44 slopes in a direction upwardly and away from the second position and toward the direction of swing of a golf club. Reference may be had to the clearly defined slope angle P noted in FIG. 3. By virtue of this slope, and also by virtue of the concave region 41 defined adjacent the point where the simulated ball 46 meets the stem, the stem 44 is substantially protected from contact with the head of the golf club during the course of a normal stroke. In other words, the simulated golf ball 46 is struck by the club head regardless of the number of the club used. The number 9 iron, for example, can be used without fear of injury to the stem 44.

The rearward slope of stem 44 at angle P as noted above also substantially eliminates a non-linearity problem that can occur when measuring how hard the simulated ball has been hit by the golf club. If the ball member is arranged such that the stem extends vertically when in the first position, it has been found that the time taken for the ball member to move from the first position to the second position is not always directly proportional to the magnitude of the impact of the golf club head with the simulated ball.

When the simulated ball 46 is hit, forces are induced therein and the directions and relative magnitudes are approximately given by the vectors shown in FIG. 4.

With reference now to position PB, it will be seen that the stem 44 is bent slightly forward and that the heel 40 has lifted away from the coil 56 in the ball support. It has been found that the amount of forward bend in the stem 44 is directly proportional to how hard the simulated ball has been hit. Various forces at this point are being dissipated with the vectors illustrated indicating the directions and relative magnitudes of the forces involved.

With reference to position PC, it will be seen that the stem of the ball member 38 has straightened out slightly with the forces being dissipated in the directions of the vectors illustrated in the drawing. The stem 44 will tend to elongate slightly at this position with the amount of elongation increasing the harder the simulated ball is hit.

With reference to position PD, the stem 44 of the ball member will be slightly elongated and bent forwardly just prior to impact with the sensor pad 32. As a result, part of the force is dissipated up the stem 44. The stem will straighten out and conform to the contour of the sensor pad 32 as described previously and will compress the pad in the areas marked in dashed lines on FIG. 4 and dissipate the remaining applied forces on the ball member.

Returning to FIG. 3 it will be noted that the portion of the sensor pad which is nearest to the axle 52 is provided with a convexly contoured hump 37. This hump 37 is contoured to complement the concavely contoured portion 39 defined by the stem 44 and the simulated golf ball 46 on the frontal portion thereof. Hence, as the ball member 38 moves to the second position, the simulated golf ball 46 initially makes contact with the surface of the sensor pad 32 as described above thus clearly defining the point of impact thereby to provide an accurate indication of direction to the sensor of the ribbon switch 60. However, immediately after initial contact is made, the stem 44 flexes and makes contact along a very substantial portion of its length with the convexly contoured hump 37 referred to above. This feature assists in reducing excessive flexing of stem 44 and helps to reduce stresses in the elastomeric material thus prolonging its life.

The ball member 38 is then returned to the first position, i.e. position PA, by an elastic band 45 which is attached to the arcuately curved surface of the foot portion 42 of the ball member with this elastic band extending forwardly and being secured at its other end beneath the sensor pad as illustrated in dashed lines in FIGS. 3 and 4.

Referring now to FIG. 9 there is shown in somewhat diagrammatic form the wiring and the various components contained within the monitor housing 16 and the monitor stand 14. The wiring includes input power cord 70 for connection to a wall outlet (120 VAC), such power cord being connected to the monitor power cord 72 and to the power supply cord 74 for the computer power supply transformer 76. Line 78 carries the transformer output to the power input of the computer 80. The computer output port 82 is connected to monitor 20 by way of line 84 thereby to supply audio and video signals to the nonitor.

Control signals from the ball assembly 26 are supplied via input wiring harness 86 to the input control ports 88 of the computer. Key pad 90 containing control buttons to be hereafter described) also has its input and output leads connected into the wiring harness 86. Input port 92 is connected via conductors 94 to the coin chute and box assembly 24.

The computer 80 may comprise any one of several well known commercially available computers such as the "Commodore 64", "Intelvision", "Atari", "Coleco", "Apple", "IBM PC" (all registered Trademarks), and others but the invention is by no means limited to these particular computers. Alternatively the computer may be custom designed. Almost any computer with sufficient speed and available memory can be programmed to carry out the functions to be described hereafter.

Operation

The unit recognizes (by the use of a suitable pressure switch or the like), that someone has stepped onto it and changes its display mode to induce people to insert money into the unit.

A sign "PLAY ME" will flash on the screen, and the unit will make an intermittent "ping" sound. As the required coins are deposited in the coin chute the unit acknowledges receipt of each coin with a tone sound. If part of a previous game was left on the unit the insertion of a coin will cancel the remaining part of the game.

Insertion of coins will determine if the unit should be set up for one or two players.

The user can be asked to indicate if he or she is a 1st time user or an experienced user. This is done through an alternating flashing display:

"1ST TIME USER"

"EXPERIENCED USER"

Depression of a control button 22 on the key pad when one or the other is flashing will indicate to the unit which of these the user is. A first time user will get a more detailed set of instructions than an experienced user.

The user can also be asked if he or she is a right or left handed player. Again, an alternating flashing display will appear on the screen reading:

"RIGHT HANDED"

"LEFT HANDED"

The push of a button when one or the other is flashing will tell the unit which the user is.

The unit can also be arranged to detect which way the ball assembly 26 is facing (set up for a right and left hand player). If the ball assembly 26 is facing in the wrong direction the unit can display a picture of the ball assembly being turned around. The unit in this case will not proceed further into the program until the ball assembly is facing in the correct direction.

(The unit can detect direction of ball assembly via a magnet and reed relay (not shown). The magnet may be located in the ball assembly 26 while the reed relay is located in the base 12.)

When two people play, one right handed and one left handed, the unit will keep track of each player and make certain that the ball assembly is facing in the correct direction by not proceeding into the program if the ball assembly 26 is facing the wrong direction.

When the ball assembly is turned correctly the unit will proceed as follows:

The user will be offered a variety of courses to play. The following will be alternatively flashed on the screen:

"DRIVING RANGE"

"GOLF COURSE"

Pushing a button when one or the other is flashing will tell the unit which of the above the user would like to play.

Driving Range

IF the user selects "DRIVING RANGE" he or she will have a further choice to make. The choices are as follows:

| | |
|---|---|
| 300 YARD DRIVING RANGE | (Professional Range - Standard) |
| 200 YARD DRIVING RANGE | (Intermediate Range - beginning adults) |
| 100 YARD DRIVING RANGE | (Beginning range - children) |

If no selection is made within 5 seconds or if a player has indicated that he or she is an experienced player earlier, the unit will automatically select the 300 YARD DRIVING RANGE.

Selection will be made as follows. Each of the above choices will flash alternately. The user will press a button when his or her choice is flashing. If the ball assembly is turned in the correct direction the unit is ready to play.

Different fairway pictures are used for the driving range and the golf course.

There are random bird noises when the unit is not being used. When the ball is hit into the woods, occasionally there will be a cow sound or a bird flying out of the woods.

After the selection, the monitor will display the corresponding driving range, reference being had to FIG. 11. The driving range as depicted is similar to the golf course shown in FIG. 10 but of a simplified nature. It includes a fairway FW, trees or woods W, waters and sand WH and ST, a green G and a tee position TT. There are five signs displaying player number, stroke number and yardages etc. as discussed below. Sign (S2) will contain Stroke 1, Player 1 which indicates that player one is to take his first shot. Once a shot has been taken, money will not be accepted for two player operation or future games until the game is over.

After player one has struck the ball, sign (S3) and sign (S4) will simultaneously begin to count the yardage travelled. A trace line will show the ball's direction (7 possible directions as described). Any stroke will take six seconds to complete its path on the monitor. Sign (S3) will stay lit for four seconds after the ball stops and indicate the yardage for that particular stroke. Sign (S4) will show the accumulated yardage of all strokes for player 1.

If the unit is set up for two players, sign (S2) will display Stroke 1, Player 2 after player one's first stroke is finished. Sign (S3) will work for player two as did sign (S4) for player one (S5) will show the accumulated yardage for player two.

The ball travels further (up the driving range) the harder it is hit, but takes six seconds to travel regardless of distance. The unit "pings" at 20 yard intervals on the 400 yard driving range. (10 yard intervals on the 200 yard driving range and 5 yard intervals on the 100 yard driving range.)

The game will alternate between the two players until each has six strokes accumulated (The exception to this is the one hole golf course discussed later.)

The player must wait until the ball is visible on the bottom of the screen before attempting to hit it again, (Otherwise, nothing happens).

After both players have completed six strokes, the unit indicates that the game is over and the unit will then be ready to accept coins again.

When the driving range is being played the golfer may be given an average distance and a rating at the end of the game such as "SUPER PRO". The higher the average yardage, the better the rating. Ratings begin at 130 yards and go up to 350 plus yards.

Left handed players need only reverse the ball assembly 26 in the standing platform. The ball assembly 26 pulls straight up and can be flipped around and pushed back into place as described previously.

Golf Course

If the user selects "GOLF COURSE" the unit goes into the golf course display (see FIG. 10) and the unit is ready to play. With reference to FIG. 10 the monitor display of the simulated golf course is shown. It shows a fairway FW with woods WW on opposite sides of the fairway. Water hazards WH and roughs RR are shown as well as a sand trap ST. The green G includes the hole near the top of the display while the tee position is shown near the bottom of the display and labelled TT. Signs adjacent the four corners of the display indicate the playing time left, the distance to the hole, the game number, the stroke count for the player, the tee to hole distance and the par numbers etc.

Game Play—Golf Course

Figure 12:
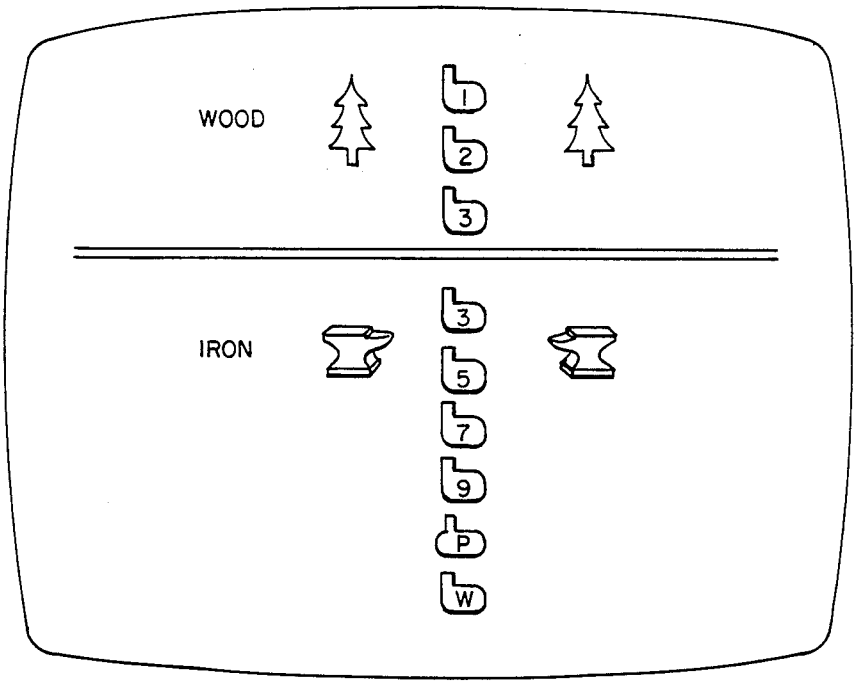
FIG. 12 is a further monitor display facilitating club selection.

After the 1st stroke, the player will be offered a choice of clubs for his or her second stroke on selected units. This choice will be given by causing a set of golf clubs to flash alternatively on the screen (see FIG. 12) and through a push of a control button on the key pad when a given club is flashing the user can register his choice.

Some units (depending on location) will not offer a choice of clubs in which case the user will play the entire game with a number 1 wood.

During the course of game play the monitor will display the regular 400 yard fairway (approximately 305 yards from tee to hole). With this one hole option, players receive two minutes each in order to play. Players do not alternate strokes. The sign (S3) disappears and the sign (S4) becomes the two minute timer. Sign (S5) will indicate "yards to go" from the ball to the hole. In other words, the distance the ball travels is not indicated.

After player one has hit the ball, the ball will move (without tracing lines) to its destined position. A "tee" line behind the ball in its new position (see TTT) will indicate direction to the hole (green). The same "player one" can hit the ball right away (no delay time). The ball will take one of seven directions as it did with the driving range. A perfectly hit ball will, of course, travel straight directly toward the hole (green).

If a player lands his/her ball on the green G it is considered as having gone into the hole and the ball returns (after a short delay) back to the tee TT. A player plays until six strokes total have accumulated or two minutes, whichever comes first. If a player lands the ball on the green G in two strokes or less, the stroke counter resets to zero but the timer goes on.

Any ball hit into the woods W will be teed up again at the nearest point on the fairway and the player will lose a stroke. Similarly, if the ball lands in the water hazard WH, the program is arranged to move the ball to the nearest adjacent land area and the player is assessed two penalty strokes. Provision can be made for a bonus, e.g., a free game in the event the green is reached in less than par e.g. a "birdie".

End of Game

At the end of either form of game the unit can be arranged to flash a sign on the screen such as:

"INSERT MORE MONEY"

This sign may be accompanied by a intermittent tone similar to that used on planes and in cars to indicate an announcement or a warning.

At Rest

The unit will play itself so that a first time user by observation can see how the unit is played.

The bird sounds etc. will be played alternatively with the above to gain attention.

The following description relates to software routines for the golf simulator. Such routines may not include every feature noted above. However, it is believed that an experienced programmer will be able to provide operational features noted above but not specifically described hereafter.

Software Routines

When initially powered up, the computer initializes its various input and output ports and also resets a number of variables with which to begin the game. As previously mentioned, the input ports 88 and 92 receive the data relating to the direction and duration of ball movement from the ball assembly 26, the number of coins deposited in the golf simulator, and the choices selected by players from menus placed on monitor 20. The output port 82 is connected to monitor 20. The initialization procedure is only performed each time power is initially applied to the computer; power in the computer then maintains such initial values. The software for the golf simulator will be described in terms of four large routines. Those skilled in the art of computer programming will appreciate that the four large routines are actually comprised of a large number of small routines which are accessed in a certain order by the large routines. The small routine programs will be described in terms of their function only since their implementation will vary from programmer to programmer. The four large programs to be described are MAIN which is the overall program operating the golf simulator, and the routines GETDIR, MVBLDR, MVBLGC, and INTBAL, which are found in main.

Figure 13A:
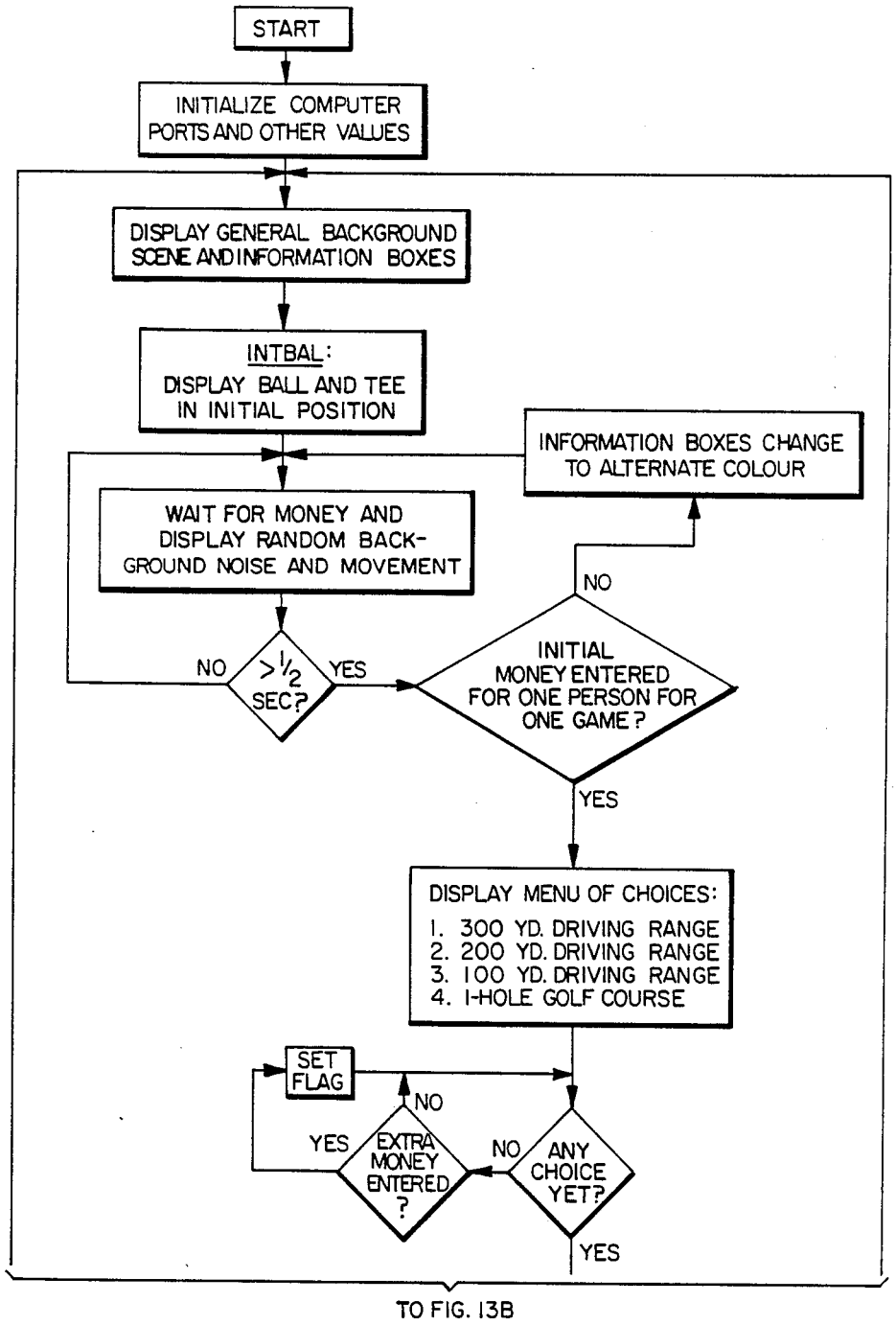
FIGS. 13A, 13B, 14A, 14B, 15A, 15B, 16A and 16B are logic flow diagrams further illustrating the operation of the golf simulator.
Figure 13B:
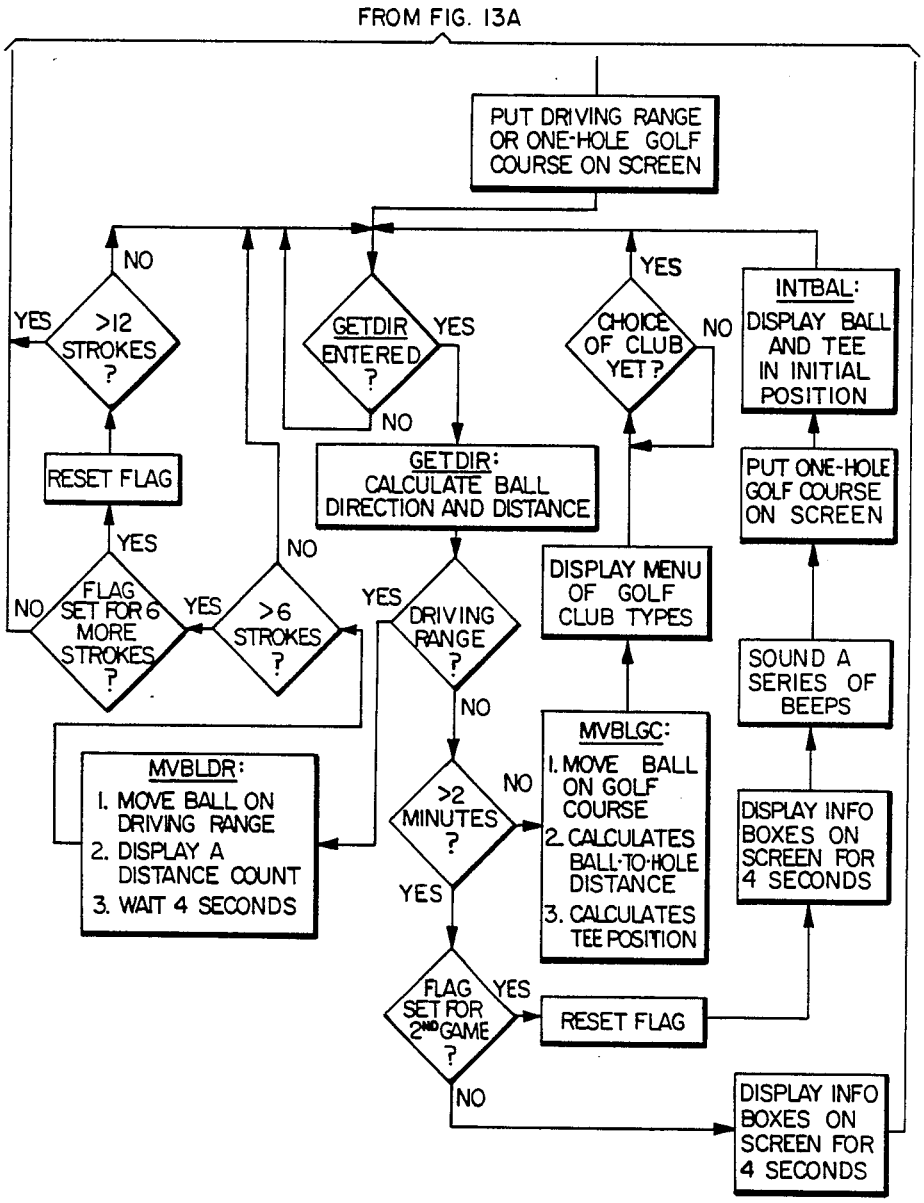

FIG. 13 is a flow diagram for the MAIN routine. After initialization of the input and output ports and the resetting of variables on the application of power to the golf simulator, MAIN displays a general background scene on the monitor. The scene comprises a golf fairway having a green, bunkers, water, roughs and trees; information boxes are then placed in the corners of the monitor screen. A routine called INTBAL then places a representation of a ball and tee at the bottom center of the screen; this routine is utilized whenever a player of the game is required to shoot a ball from the initial tee position on the fairway. As shown in FIG. 13, the MAIN routine then waits for money to be placed in the coin chute and box assembly 24. While waiting for sufficient money to be deposited for one person to play one game, the screen displays noise and movement in the form of random bird flights and sounds; a random number generator is utilized for that purpose. Every one-half second the routine tests for the money and then alternates the colour of the information boxes, the boxes being white fcr one-half second and grey for the next one-half second. The words "PLAY ME" can also be flashed in a corner of the screen during this time. The insertion of a coin in the simulator can be accompanied by a sound where multiple such coins are required to commence a game. When sufficient coins have been inserted to commence a game, a fresh golf fairway scene is inserted on the screen and then a menu is displayed. The menu consists of the three driving ranges (100 yds., 200 yds., and 300 yds.) and the one-hole golf course. Prior to any choice being entered by a player pressing one of the control buttons 22, the MAIN routine looks for the entry of more money in coin chute and box assembly 24. If sufficient money is entered prior to an entry being made on the buttons 22, a flag is set in a RAM storage area which will allow a second game to be automatically played on the one-hole golf course or allow 12 rather than 6 strokes to be played on the driving range, that is, six strokes each for six players depending on which button 22 is subsequently pressed. Modern computer programs allow a broad range of colors to be utilized, and for purposes of the MAIN routine the menu is formed by white characters on a green background.

Once a choice is made by pressing one of the buttons 22 the screen is filled with the image of either the one-hole golf course or the driving range, whichever has been selected. The routine GETDIR then waits for the player to hit the golf ball 46, and more particularly for the magnet 58 in ball member 38 to move away from the core of coil 56. GETDIR calculates both the distance and direction that the ball is hit. Control is then passed to either the MVBLDR or MVBLGC routine, depending on whether a driving range or the one-hole golf course has been selected. A two minute timer is activated as soon as the one-hole golf course is selected, and a time test is undertaken after each pass through the GETDIR routine and prior to entering the MVBLGC routine to determine if the two minutes has been exceeded. If the two minutes is exceeded, then the flag in the RAM storage area is examined to determine if money was inserted for a second one-hole course to be played. If such money was inserted, the information boxes maintain their contents on the screen for four seconds, several beeps are made, and then the one-hole course is redisplayed with the INTBAL routine placing the ball and tee at the initial position. The MVBLGC routine will be more fully described, but its purpose is to move the ball on the one-hole golf course according to the input from the GETDIR routine, calculate the ball-to-hole distance, and calculate a new tee line position. After each pass through the MVBLGC routine and prior to re-entering the GETDIR routine, it is possible to display a menu of various types of golf clubs and request that a selection be made by the player. The distance measured by the GETDIR routine can then be weighted according to the particular club selected.

If one of the driving ranges had been selected by the player, the MVBLDR routine follows the GETDIR routine and receives the distance and direction values frcm the GETDIR routine. The MVBLDR routine will be more fully discussed subsequently, but its basic function is to move the ball on the driving range and display a distance count on the screen. As shown in FIG. 13, the MAIN routine tests to determine if six strokes have been played after leaving the MVBLDR routine. If six strokes have not been played, a return is made to the entry of the GETDIR routine. If six strokes have been played, then the flag in the RAM storage area is tested to determine if the money for playing an extra six strokes was deposited. In other words the game is set up for two players if in the driving range mode or alternatively for two games if the golf course has been selected. If the money was deposited, a return is made to the entry of the GETDIR routine; if no such money was deposited, the simulator returns to its idle state and the golf fairway scene is returned to the screen until sufficient money is placed in the simulator to play another game.

The GETDIR, MVBLDR, and MVBLGC routines will next be described in greater detail.

Figure 14A:
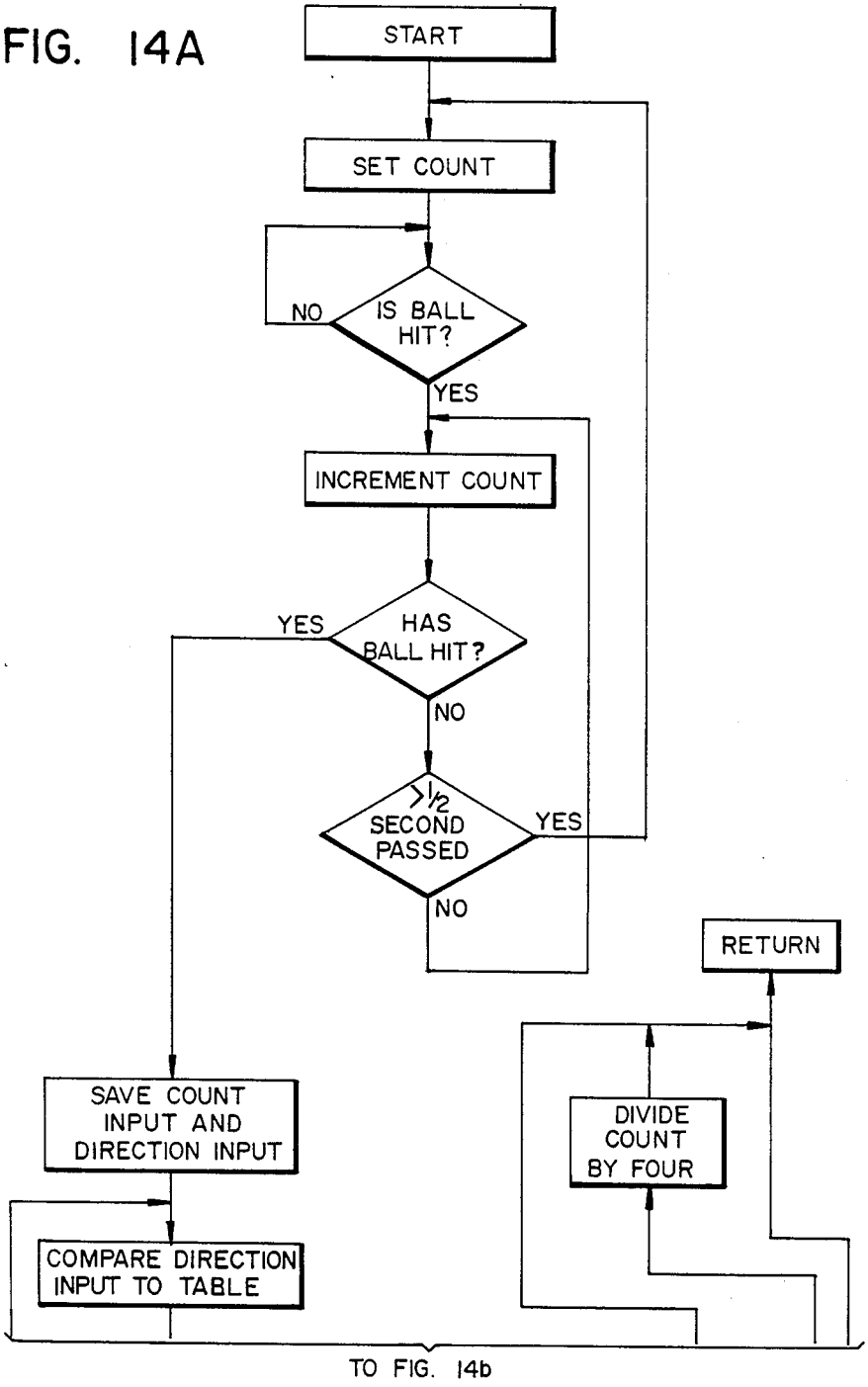
Figure 14B:
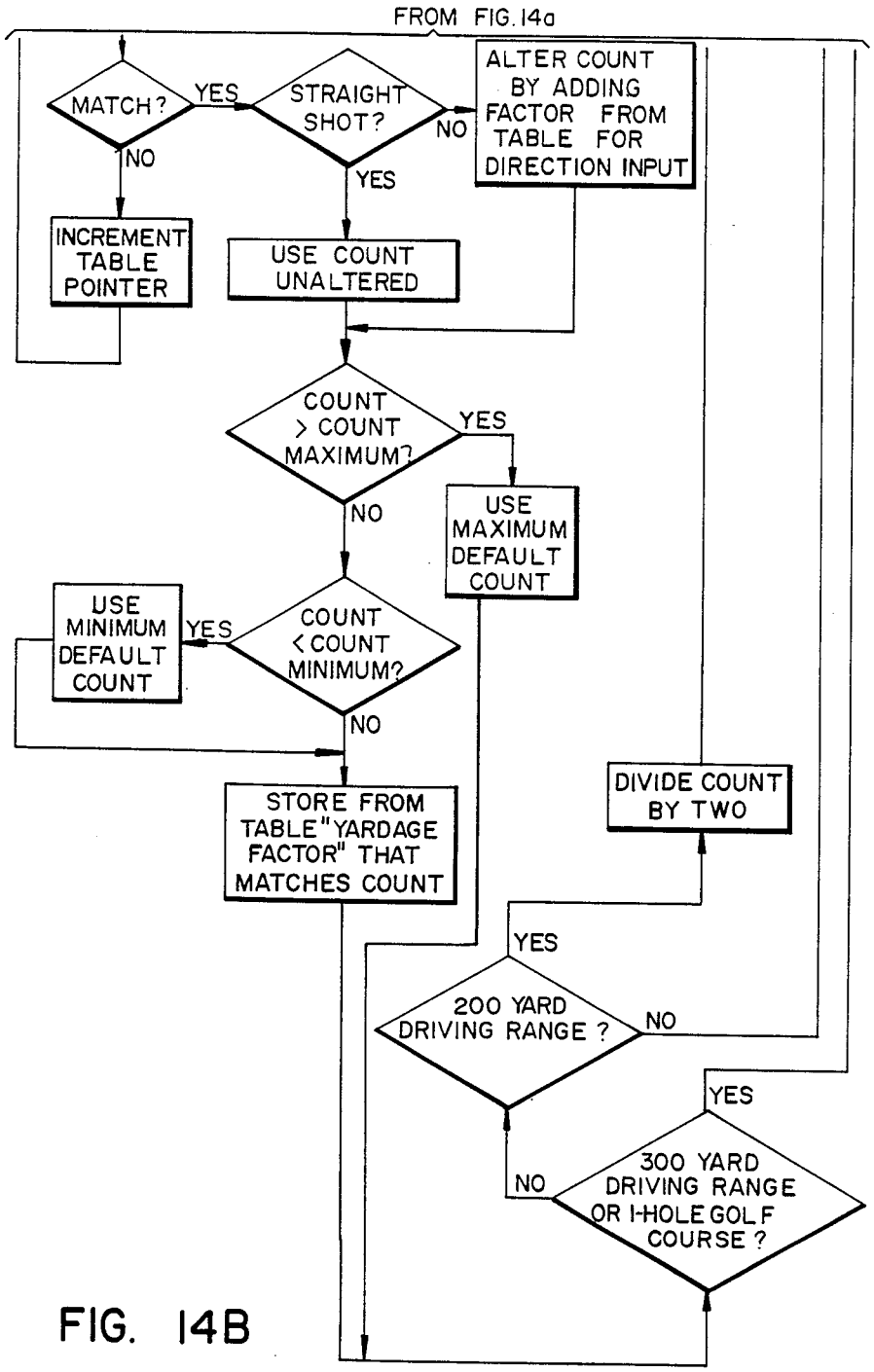

FIG. 14 is a flow diagram for the GETDIR routine. The basic function of this routine is to translate the force and direction applied to ball member 38 into a value representing the position at which the ball comes to rest on the one-hole golf course or the selected driving range. When the GETDIR routine is entered, a zero value is entered into a register that will henceforth be termed the count register. The count register does not increment until the computer senses that ball member 38 has been struck. As previously described, movement of ball member 38 is signalled by magnet 58 secured thereto moving out of the magnetic field of coil 56. That movement instantaneously changes the voltage on one of the pins of input port 88 from low to high and the count register is incremented. As shown in FIG. 14, a loop is then entered which continues to increment the count register until the earlier of 0.5 seconds or a signal indicating that ball member 38 has struck sensor pad 32. If the loop does continue for 0.5 seconds, the software assumes that ball member 38 was struck too lightly to make an impression on sensor pad 32; the routine then returns to the start of the GETDIR routine with the count register reset to zero.

After the computer senses that ball member 38 has been put in motion, it immediately moves to another routine to determine whether one or more of four pins of input port 88 assumes a low voltage. Such low voltage will be created if the large contact area E of ribbon switch 60 (see FIG. 6), which is grounded, is brought against one or more of the contact areas C, A, B and D. The four input pins will be continuously sensed for a high-to-low voltage transition in the same loop in which the count register is incremented. A value of 4000 in the count register (equivalent to approximately 0.5 seconds) terminates the loop and, as mentioned, returns control to the start of the GETDIR routine. If, however, one or more of the four pins of input port 88 is sensed to have a low voltage within the 0.5 seconds, the value of the count register and the identity of the pins that were sensed to have a low voltage are placed into a RAM storage area. Next, the GETDIR routine compares the stored direction data, as calculated from the identified one or more low-voltage pins, with values in a memory table. A subroutine increments a table pointer until the match is made. Next, the GETDIR routine determines whether a "straight shot" has been made. If so, the stored value from the count register will be the value further utilized by the GETDIR routine. If, however, ball member 38 has struck sensor pad 32 other than along the plane Y—Y (see FIG. 5), as determined from the stored direction data, the value stored in memory from the count register is incremented by a factor from a memory table. The greater the deviation from plane Y—Y that ball member 38 strikes sensor pad 32, the greater the value added to the value saved from the count register in determining the count value that will be further utilized in the GETDIR routine. The effect of adding such a "direction factor" to the stored count value is equivalent to calculating the length of the hypotenuse of a right-angled triangle having its base on plane Y—Y.

The value for count that has been determined is then compared with a minimum and maximum value; if it is above the maximum (slow ball movement) or below the minimum (fast ball movement), a default maximum or minimum value is used for the count value. Any resultant count value below the maximum default value as then assigned a "yardage factor" that matches the count value in a memory table. That "yardage factor" is then stored in a RAM storage area for use in either the MVBLDR routine or the MVBLGC routine, whichever routine is applicable to the game being played. The GETDIR routine then performs one final function. That function is to vary the count value determined thus far in the GETDIR routine by modifying it for either the 200 yard or 100 yard driving ranges; the count value is not modified for the 300 yard driving range of the one-hole golf course. For the 200 yard driving range the count value is divided by two, and for the 100 yard driving range the count value is divided by four. The count value thus determined is then stored in the RAM storage area. The direction value obtained from the four pins of input port 88 is also stored in that memory area, as also is the "yardage factor" value.

The routines MVBLDR and MVBLGC both utilize a short routine called DELAYY. The DELAYY routine uses the count value and yardage factor value from the GETDIR routine to calculate a pixel-to-pixel time factor. That time factor is based upon a six-second movement of the ball on the screen from the position at which it is hit to the position at which it comes to rest ("resultant rest position"). Although the computer calculates the resultant rest position in a matter of microseconds and could almost instantaneously place the ball at the new position, it is desired to create an effect in the game of movement of the ball close to what would be experienced by a golfer on an actual golf course. The six-second period was therefore chosen for the duration of ball movement after each hit in both the MVBLDR and MVBLGC routines. As discussed with respect to the GETDIR routine, the count value stored at the end of that routine is inversely proportional to the amount of power with which the ball is hit. That count value is decremented in the DELAAY routine to zero, with each decrementing loop passing through an inner loop in which the "yardage factor" value from the GETDIR routine is decremented to zero. As mentioned, the "yardage factor" value is selected from a position in a memory table matching the count value, and the "yardage factor" values are calculated for obtaining a correct pixel-to-pixel time value for each count value. With this background in mind, the MVBLGC and MVBLDR routines will next be discussed.

Figure 15A:
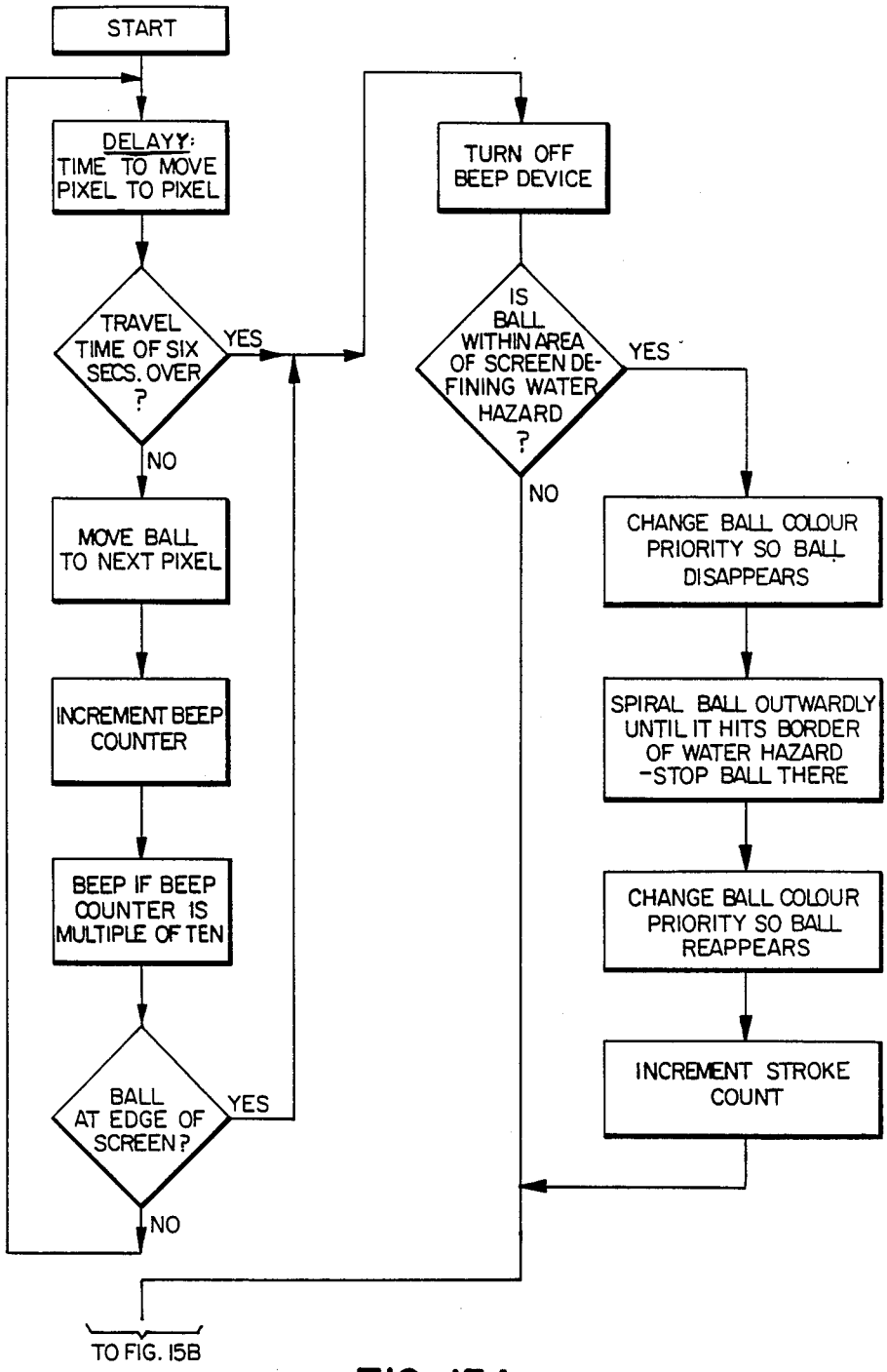
Figure 15B:
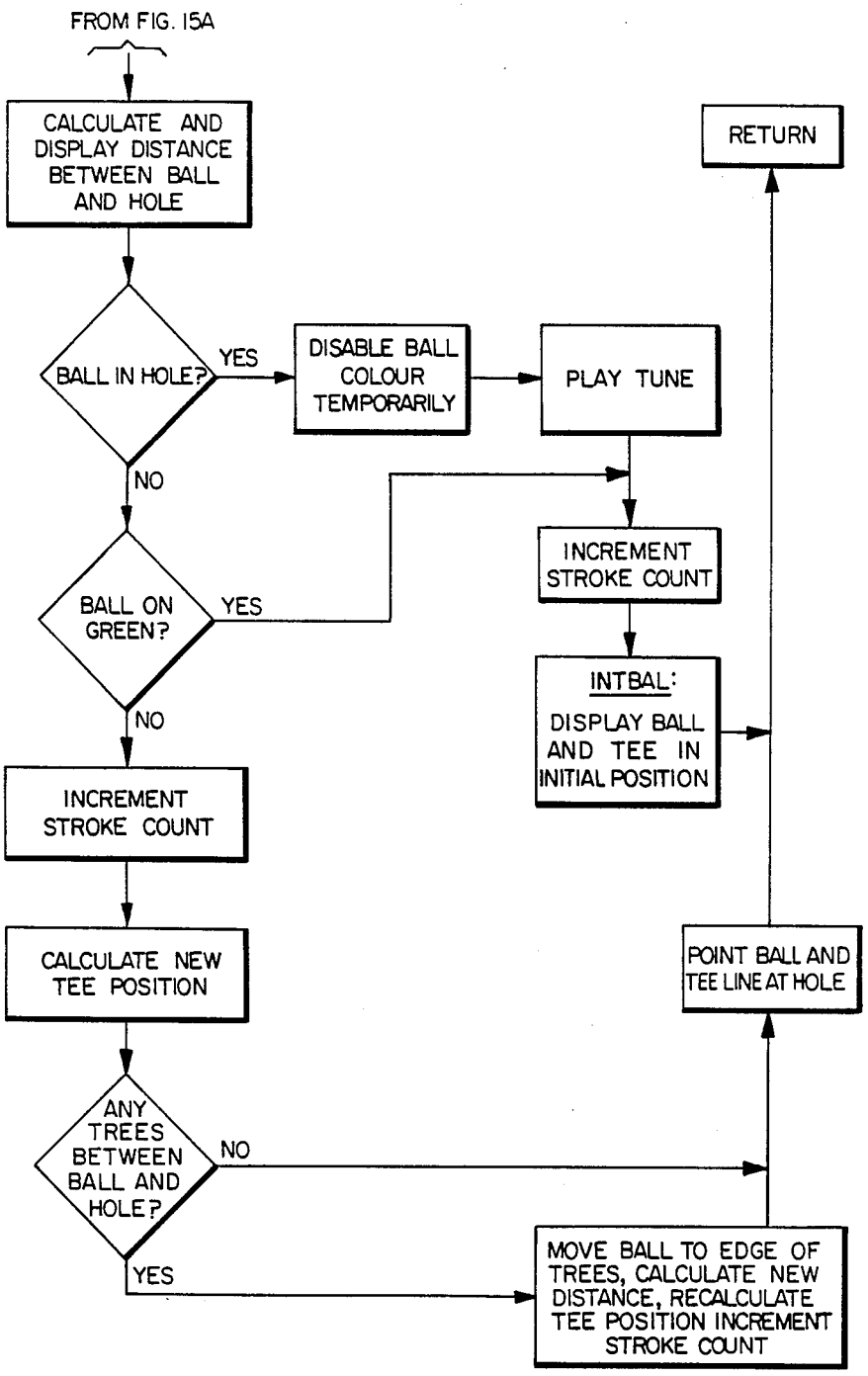

The MVBLGC routine is utilized after each pass through the GETDIR routine if the one-hole golf course has been selected. With reference to FIG. 15, the MVBLGC routine initially comprises a loop, each pass through the loop representing a pixel-to-pixel movement of the ball on the monitor screen. The time factor for that movement is created by the DELAYY routine. The loop continues for six seconds unless at some earlier time, during calculation in the loop of the new pixel location for the ball utilizing the direction and count values from the GETDIR routine, the ball is calculated as having moved off the edge of the monitor screen. If the ball is calculated as moving off the edge of the screen, its resultant rest position is deemed to be the point where it contacted the screen edge. While in the ball movement loop, a "beep counter" is incremented after each pixel movement, a beep being sounded at every multiple of ten on the beep counter. After leaving the loop the beep device is de-activated. Next, a series of tests are performed to determine whether the ball's resultant rest position is in the hole, on the green, in a water hazard, or shielded from the hole by trees. FIG. 15 illustrates the various steps taken if one of the aforementioned situations exists. Further subroutines could be added to the MVBLGC routine to cover the situation where the ball in its resultant rest position is, for instance, in a "rough".

If the ball in its resultant rest position is in a water hazard, subroutines are employed to move the ball to the nearest piece of land surrounding the ball's rest position. As can be seen in FIG. 15, the priority of colors between the ball and the water is such that the water color overrides the ball color and the ball is caused to disappear as it crosses the boundary of the water. A subroutine is then employed to "spiral the ball outwardly" until it first hits a border of the water hazard. The movement of the ball is stopped at that position and the ball reappears since its color has greater priority than that of the land surrounding the water hazard. It is possible that the ball when repositioned next to the water hazard is on the green of fairway. The next step in the MVBLGC routine calculates and displays the distance between the ball and the hole. A calculation may determine that the ball is "in the hole". The "hole" in this case comprises a grouping of several pixels, not just one pixel. If the ball is in the hole, the ball color is temporarily disabled and a tune is played. The stroke count is then incremented and the INTBAL routine is employed, after which the MVBLGC routine is terminated. Assuming that the ball is not in the hole, the resultant rest position of the ball is then tested to see if the ball is "on the green". If the ball is on the green, the stroke counter is incremented, the INTBAL routine is called and the MVBLGC routine is terminated. If the ball is neither in the hole nor on the green, then the stroke counter is incremented and a "new tee position" is calculated. Next, a calculation is performed by the routine to determine whether any trees extend on the line between the ball and the hole. If there are such trees, the ball is moved to the edge of the trees, a new distance to the hole is calculated, and the tee position is recalculated. As is the case when the ball lands in the water hazard, the stroke counter is incremented as a penalty. Once the tee position has been recalculated, the ball and tee are displayed on the screen at that position. The routine orients the position of the tee such that it extends normal to a line drawn between the hole and the ball. The MVBLGC routine then terminates.

Figure 16A:
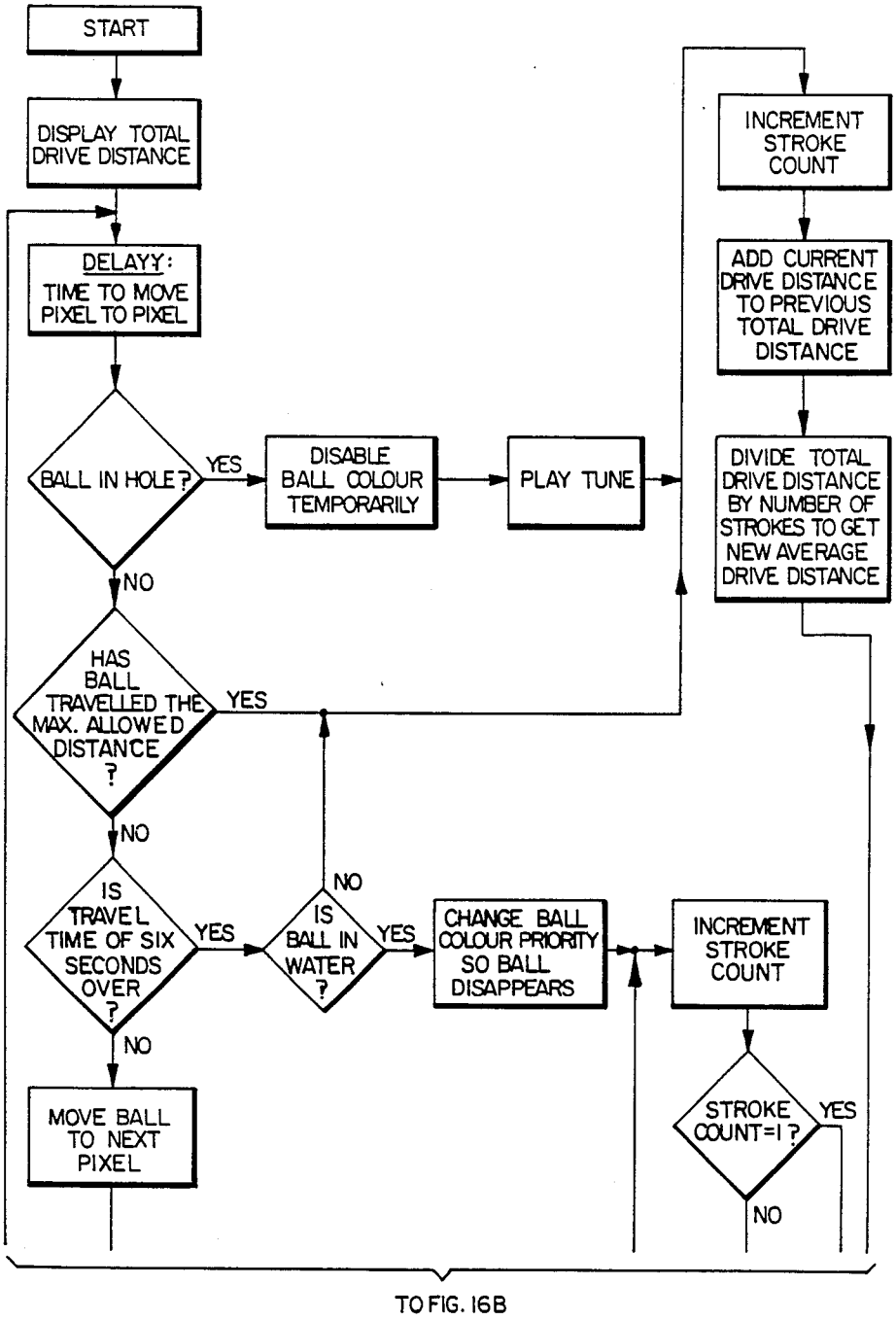
Figure 16B:
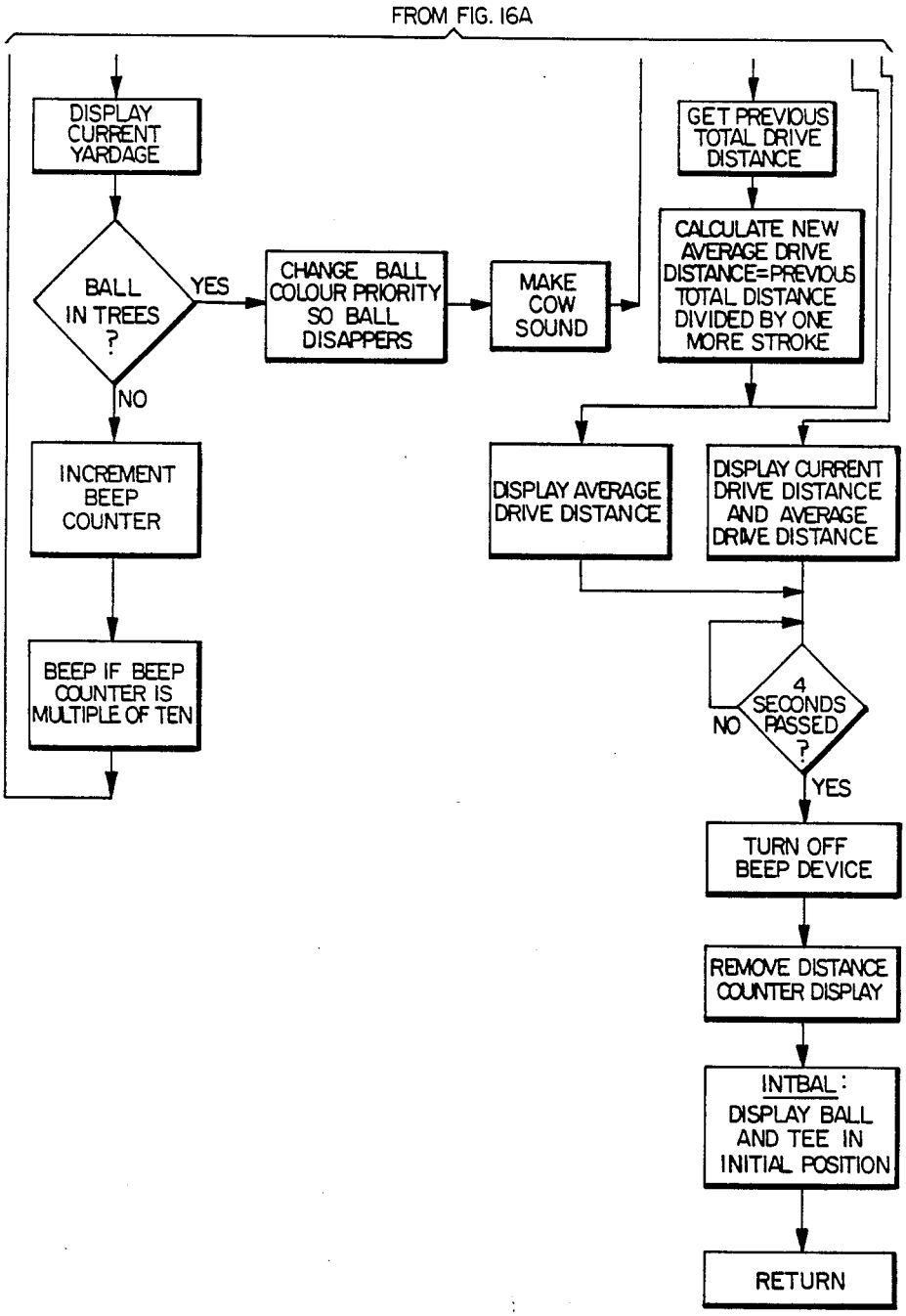

The MVBLDR routine, which is utilized with the driving range option, is illustrated in FIG. 16. On entering this routine, the total of the drive distances from previous passes during the game through this routine is removed from a RAM storage area and displayed in one of the information boxes featured on the driving range display. The DELAYY routine is then called to provide a time delay for pixel-to-pixel movement. The MVBLDR routine then loops for a maximum of six seconds. An exit may be made from the loop sooner if, from the continual testing of the ball's position, the ball is found to have passed across the hole, passed into an area occupied by trees, or travelled the maximum allowed distance. The "yardage factor" value of the GETDIR routine corresponding to the minimum count value is such that the maximum allowed distance (316 yards) can occur prior to six seconds. Each time that a pass is made through the loop, the ball is moved to the next pixel in the line-of-flight calculated from values stored by the GETDIR routine, and a beep counter is incremented; a beep is sounded after each multiple of ten registered by the beep counter. The four ways of exiting the loop containing the DELAYY routines lead to two paths, one path in which the distance from the golf stroke is included in the total drive distance and the other path in which it is not. With reference to FIG. 16, the distance gained on the golf stroke is included if the ball enters the hole, or if the ball has travelled the maximum allowed distance (316 yards), or if the travel time in the loop exceeds six seconds and the ball is not determined to be in a water hazard at the end of those six seconds. In those three cases the stroke counter is incremented, the current drive distance is added to the total drive distance (the distance stored in memory from earlier passes through the MVBLDR routine), and the new total drive distance (including the drive distance gained during this pass through the MVBLDR routine) is divided by the number of strokes (including this pass through the MVBLDR routine) to obtain a new average drive distance.

In comparison, the parallel path out of the loop containing the DELAYY routine does not add the drive distance from this pass through the MVBLDR routine to the total drive distance stored from other passes through the MVBLDR routine. As a result, the total drive distance existing upon entry to the MVBLDR routine is divided by one plus the number of strokes entering the routine which always results in a reduction in the calculated new average drive distance. This second path is entered if the travel time around the loop containing the DELAYY routine exceeds six seconds and the resultant rest position of the ball is in the water at the end of that time; in such case the ball disappears as in the MVBLIC routine and the second path is then entered. The second path is also entered if less than six seconds have passed in the loop containing the DELAYY routine but a calculation in that loop indicates that the ball has entered the trees. In that case the ball disappears and a cow sound is made by the simulator. As with the MVBLGC routine, if the ball is sensed to be in the hole the ball color is disabled temporarily and the simulator plays a tune. Whereas the above-discussed first path results in both the current drive distance and the average drive distance being displayed, only the average drive distance is displayed after passage through the second path. Both of the paths then converge into a four-second wait routine during which the drive distance values remain on the display. The beep device is then turned off and the drive distance display is removed from the screen. The INTBAL routine is then called to display the ball and tee in the initial position and control is then returned to the MAIN routine.

It is of course possible to alter each of the described routines in various ways. For instance, it is possible to have a hardware interrupt connected to the signal entering the computer from coin chute and box assembly 24, that interrupt driving a routine for evaluating the money being entered. In that way, the depositing of money into the simulator can be sensed and value of such money determined throughout the running of all of the routines previously-discussed. Another feature that can be added to the software involves limiting the amount of time that is allowed for one game on the driving range. The effect would be similar to the two minutes allowed for one game on the one-hole golf course. A player who had paid for one game on the driving range would then be allowed the lesser of the time limit (say, two minutes) and the time taken to take six strokes. The time limit would be doubled if extra money had been entered in the coin box of the simulator. The MAIN routine could also be altered to allow two or more players to take alternate shots on the driving ranges, and information boxes could be added to the screen to record each of their drive distances.

I claim:

1. A golf simulator comprising:

a movable ball means comprising a stem having a simulated golf ball connected to an outer end thereof, means supporting said movable ball means for rotation about an axis from a first position to a second position in response to impact between said simulated golf ball and the head of a golf club being swung by a user, a plane of movement being defined by an imaginary plane which is normal to said axis and in which plane the simulated ball is located when in the first position;

at least one of (a) said movable ball means and (b) said means supporting said movable ball means being sufficiently resiliently deformable or deflectable that said simulated golf ball can be momentarily deviated to one side or the other of said plane of movement in response to at least the angle of impact of said club head with the simulated golf ball relative to said plane of movement, sensor means including a first sensor and a second sensor, said first sensor including means for sensing movement of the movable ball means away from the first position, said second sensor including means for sensing impact thereon of the movable ball means on arrival at the second position and any deviation of the simulated golf ball from the plane of movement, and means for computing distance and direction of ball travel from outputs of the first and second sensors.

2. The golf simulator of claim 1 wherein said movable ball means is a resiliently deformable rubber or rubber-like material.

3. The golf simulator of claim 1 wherein said supporting means is a resiliently deformable rubber or rubber-like material.

4. The golf simulator of claim 1 wherein said second sensor comprises an array of sensors located so as to be responsive to pressures acting thereon developed by the arrival of said ball means including said simulated golf ball at said second position.

5. The golf simulator of claim 4 wherein said second position is defined by a sensor pad arranged so as to be impacted by said simulated golf ball on reaching said second position and including a layer of resiliently deformable material for absorbing the shock of impact of said simulated ball at said second position, with said array of sensors being located beneath said layer of material and disposed on opposing sides of said plane of movement and responsive to pressure waves transmitted through said material from the point of impact on the surface thereof.

6. The golf simulator of claim 5 wherein said movable ball means comprises a unitary body and said sensor pad is shaped such that the simulated ball initially impacts with the pad surface to clearly define the point of impact and immediately thereafter said stem ingages and is supported by said pad to reduce stresses therein.

7. The golf simulator of claim 5 wherein both said movable ball means and said sensor pad comprise a resilient elastomeric material, said movable ball means having a hardness which is greater than the hardness of the sensor pad.

8. The golf simulator of claim 7 wherein said supporting means is formed integrally with said sensor pad, said supporting means comprising members supporting an axle defining the axis of rotation of said movable ball means from the first to the second position.

9. The golf simulator according to claim 1 wherein said movable ball means and said supporting means are arranged so that the stem of the movable ball means slopes in a direction upwardly away from the second position and toward the direction of swing of a golf club so that the club head contacts the simulated ball but not the stem during the course of a normal stroke.

10. The golf simulator according to claim 1 wherein said computing means includes means capable of sensing the speed of movement of said movable ball means from the first position to the second position whereby ball direction and distance of travel may be computed in response to the total output of said sensor means.

11. The golf simulator according to claim 10 wherein the computing means is a computing system for receiving signals from said sensor means and computing ball direction and distance of travel and generating a signal representing the calculated landing position of the ball and means for displaying the calculated landing position of the ball.

12. The golf simulator according to claim 11 wherein said computing system also includes means for storing information and generating a display of a simulated fairway and/or driving range, said last-mentioned means co-operating with said means for displaying the landing position of the ball such that the display of the landing position is superimposed on the display of the simulated fairway and/or driving range.

13. The golf simulator according to claim 12 wherein the computing system further includes means storing information and generating as a part of said simulated fairway display a simulated tee-off point, a green and hole, and at least one hazard.

14. The golf simulator according to claim 12 wherein said computing system further includes means for counting the number of times the simulated ball is struck and generating a signal representing the accumulated stroke count and including the count as a part of the display.

15. The golf simulator according to claim 13, wherein the computing system includes means for registering placement of the ball in the hole when the calculated landing position of the ball is within a selected distance of the pre-calculated hole position.

16. The golf simulator according to claim 14 further including means storing the distances the ball is moved, averaging the distance and including the average distance per stroke as part of said display.

17. The golf simulator according to claim 16 wherein said computing system further includes means for rating the user according to the average distance achieved per stroke and displaying such rating.

18. The golf simulator according to claim 14 including means for disabling a portion of said computing system and to signal the end of a game of simulated golf after (a) elapse of a set period of time and/or (b) accumulation of a prescribed stroke count.

19. The golf simulator according to claim 14 wherein said computing system includes input means enabling the player to select one of several clubs, which selection alters the manner in which said computer responds to ball distance inputs from said sensor means to produce distance outputs conditioned in accordance with the club selected.

* * * * *